US011476076B2

(12) United States Patent
Ullrich

(10) Patent No.: US 11,476,076 B2
(45) Date of Patent: Oct. 18, 2022

(54) EXIT WINDOW FOR ELECTRON BEAM IN ISOTOPE PRODUCTION

(71) Applicant: Canadian Light Source Inc., Saskatoon (CA)

(72) Inventor: Douglas Ullrich, Saskatoon (CA)

(73) Assignee: Canadian Light Source Inc., Saskatoon (CA)

( * ) Notice: Subject to any disclaimer, the term of this patent is extended or adjusted under 35 U.S.C. 154(b) by 73 days.

(21) Appl. No.: 16/481,443

(22) PCT Filed: Jan. 26, 2018

(86) PCT No.: PCT/CA2018/050098

§ 371 (c)(1),
(2) Date: Jul. 26, 2019

(87) PCT Pub. No.: WO2018/137042

PCT Pub. Date: Aug. 2, 2018

(65) Prior Publication Data

US 2019/0348190 A1 Nov. 14, 2019

Related U.S. Application Data

(60) Provisional application No. 62/450,935, filed on Jan. 26, 2017.

(51) Int. Cl.

| | |
|---|---|
| ***H05H 6/00*** | (2006.01) |
| ***H01J 33/04*** | (2006.01) |
| ***G21G 1/10*** | (2006.01) |

(52) U.S. Cl.
CPC ..... *H01J 33/04* (2013.01); *G21G 1/10* (2013.01); *H05H 2006/002* (2013.01)

(58) Field of Classification Search
CPC .. H01J 5/18; H01J 33/04; H01J 35/18; H05H 2006/002

(Continued)

(56) References Cited

U.S. PATENT DOCUMENTS

| | | | |
|---|---|---|---|
| 4,324,980 | A | 4/1982 | Symmons |
| 5,235,239 | A | 8/1993 | Jacob et al. |

(Continued)

FOREIGN PATENT DOCUMENTS

| | | | |
|---|---|---|---|
| CA | 2691484 | A1 | 12/2008 |
| JP | 2001000834 | A | 1/2001 |

(Continued)

OTHER PUBLICATIONS

R. D. Brown et al., Beam Line Windows at LAMPF, IEEE Transactions on Nuclear Science,. Oct. 1, 1985, pp. 3812-3814, vol. 32, No. 5, XP055735187, ISSN:0018-9499, DOI 10.1109/TNS.1985.4334512, United States of America.

(Continued)

*Primary Examiner* — Sharon M Davis
(74) *Attorney, Agent, or Firm* — McCarthy Tétrault LLP

(57) ABSTRACT

There is provided an exit window for an electron beam from a linear accelerator for use in producing radioisotopes. The exit window comprises a cylindrical channel operatively connectable at one end to a vacuum chamber configured for travel of the electron beam; and a domed dished head at the other end of the channel, the dished head comprising a convex portion having a protruding crown configured for pass-through of the electron beam wherein the geometry of the domed dished head is proportioned to resist pressure stress created by cooling medium circulating around the protruding crown and the vacuum in the cylindrical channel and to maintain the combined cooling medium pressure stress and pulsed electron beam thermal stress below the fatigue limit of the material forming the exit window.

11 Claims, 3 Drawing Sheets

(58) Field of Classification Search
USPC ..... 313/420; 378/161
See application file for complete search history.

(56) References Cited

U.S. PATENT DOCUMENTS

| | | | | |
|---|---|---|---|---|
| 5,391,958 | A | 2/1995 | Kelly | |
| 5,524,042 | A | 6/1996 | Kovacs | |
| 5,561,342 | A | 10/1996 | Roeder et al. | |
| 5,898,261 | A | 4/1999 | Barker | |
| 7,800,012 | B2 | 9/2010 | Roche et al. | |
| 2003/0152187 | A1* | 8/2003 | Ritter | G21C 1/30 376/194 |
| 2009/0090875 | A1* | 4/2009 | Gelbart | H05H 6/00 250/492.1 |

FOREIGN PATENT DOCUMENTS

| | | | |
|---|---|---|---|
| WO | 2009000076 | A1 | 12/2008 |
| WO | 2014186898 | A1 | 11/2014 |
| WO | 2015176188 | A1 | 11/2015 |
| WO | 2016081484 | A1 | 5/2016 |

OTHER PUBLICATIONS

Murdoch et al., Beam dump window design for the spallation neutron source, Proceedings of The 2003 Particle Accelerator Conference, 2003, pp. 1467-1469, vol. 3, doi: 10.1109/PAC.2003.1288563, IEEE, Portland, United States of America.

H J Wang et al., The Design and Analysis of Proton Beam Window for CSNSIII, Proceedings of IPAC2013, Jul. 10, 2013, pp. 3367-3369, XP055735209.

Hai-Jing Wang et al., Thermal analysis and optimization of proton beam window for the CSNS, Chinese Physics C, Jul. 1, 2013, p. 077001, vol. 37, No. 7, XP055735185, ISSN: 1674-1137, DOI: 10.1088/1674-1137/37/7/077001.

International Preliminary Reporton Patentability (Chapter 1) dated Jul. 30, 2019 mailed in corresponding International application No. PCT/CA2018/050098.

Wang, H.J et al: The Design and Analysis of Proton Beam Window for CSNSIII, Proceedings of IPAC2013, Shanghai, China, 2013, p. 336-3369.

* cited by examiner

2/3

3/3

EXIT WINDOW FOR ELECTRON BEAM IN ISOTOPE PRODUCTION

CROSS REFERENCE TO RELATED APPLICATIONS

This application is a 371 of PCT Application No. PCT/CA2018/050098, filed on Jul. 26, 2018, which claims the benefit of U.S. Provisional Patent Application Ser. No. 62/450,935, filed on Jan. 26, 2017. The entirety of the contents of the referenced applications are hereby incorporated by reference.

FIELD OF THE DISCLOSURE

The invention relates to an exit window for an electron beam used for isotope production.

BACKGROUND

Commercial radioisotopes, such as $^{99}$Mo/$^{99m}$Tc, which is used as a radiotracer in nuclear medicine diagnostic procedures, are produced using nuclear fission based processes. For instance, $^{99}$Mo can be derived from the fission of highly enriched $^{235}$U.

Due to nuclear proliferation concerns and the shutdown of nuclear facilities used for producing commercial radioisotopes, alternative systems and methods are being used for producing commercial radioisotopes without the use of nuclear fission.

One such method is the use of a high energy electron linear accelerator to produce nuclear reactions within a target material through one or more reaction processes. Use of this method to produce molybdenum-99 and the systems used to produce molybdenum-99 through this method are described in Patent Cooperation Treaty Application Nos. PCT/CA2014/050479 and PCT/CA2015/050473, the entirety of which are hereby incorporated by reference.

High energy electron beams produced from an electron linear accelerator may be used for material processing (transformation or transmutation) at the nuclear level utilizing a variety of nuclear reactions. Isotopes of an element may be produced in this manner. As linear accelerators must operate in an evacuated atmosphere (i.e., under vacuum) and the processed material must be cooled to dissipate the heat caused by some of the nuclear reactions and interactions, a suitable electron beam exit window is required to separate the two environments.

Some high power electron beam windows are thin metal foil designs with many variations in layers, coatings and support structures. Thin foils are used for a variety of reasons, such as to increase the size of the window to allow the electron beam to be swept across the window, to reduce the attenuation of the electron beam by the window, and to reduce the nuclear interactions with the window itself.

As a linear accelerator produces a small axial pulsed electron beam, sweeping of the electron beam allows larger processing volumes and reduces hot spots on the window foil. Electron beam attenuation is detrimental to many electron processing technologies due to lost efficiency and the nuclear interactions with the window cause a downstream radiation shower, dynamic thermal stresses, and potential cooling challenges, all of which are proportional to the window thickness.

While the foil designs evolved to meet the current lower energy, non-nuclear reaction producing, electron beam process requirement, they were not designed for high energy electron beam isotope production utilizing the Bremsstrahlung radiation shower.

As the foil windows tend to be thin structures, they cannot withstand high pressure differentials across them. Most electron beam processing is done without forced or pressurized cooling of the target medium as the absorbed power density is much lower. The foils suffer fatigue failure due to high dynamic thermally induced stresses caused by the pulsed electron beam.

Accordingly, a solution that addresses, at least in part, the above and other shortcomings is desired.

SUMMARY OF THE DISCLOSURE

According to one aspect of the invention, there is provided an exit window for an electron beam from a linear accelerator for use in producing radioisotopes. The exit window comprises a cylindrical channel operatively connectable at one end to a vacuum chamber configured for travel of the electron beam; a domed dished head at the other end of the channel, the dished head comprising a convex portion having a protruding crown configured for pass-through of the electron beam wherein the geometry of the domed dished head is proportioned to resist pressure stress created by cooling medium circulating around the protruding crown and the vacuum in the cylindrical channel and maintain the combined thermal and pressure stress below the fatigue limit of the material forming the exit window.

In some embodiments, the domed dished head has an ellipsoidal profile. In some embodiments, the domed dished head has a torispherical profile.

In some embodiments, the domed dished head has a recessed crown radii that is 125% to 80% of the cylindrical channel's diameter. In some embodiments, the domed dished head has an inner knuckle radii that is 20% to 40% of the cylindrical channel's diameter. In some embodiments, the domed dished head has a recessed crown radii of 12 mm. In some embodiments, the domed dished head has an inner knuckle radii of 2.7 mm.

In some embodiments, the domed dished head has an inner knuckle radii that is 30% to 6% of the cylindrical channel's diameter.

In some embodiments, the protruding crown has a circular or generally oval shape. In some embodiments, the protruding crown comprises a plurality of raised portions, each of the raised portions having a smaller diameter as the protruding crown extends outwards.

In some embodiments, the exit window is a single integral piece.

In some embodiments, the exit window comprises beryllium, copper, steel, stainless steel, titanium, alloys or any of the foregoing, or a combination of any of the foregoing. In some embodiments, the exit window comprises Ti-6Al-4V.

In some embodiments, the cylindrical channel has a diameter of 6-10 mm. In some embodiments, the cylindrical channel has a diameter of 10-20 mm.

In some embodiments, the linear accelerator is capable of producing an electron beam having an energy of at least 10 MeV to about 50 MeV. In some embodiments, the linear accelerator is capable of producing an electron beam having at least 5 kW of power to about 150 kW of power. In some embodiments, the electron beam passing through the protruding crown has an energy of a least 30 MeV.

In some embodiments, the exit window is removably mountable to a window flange.

In some embodiments, the combined pressure stress resulting from the cooling medium and thermal stress resulting from pulsed electron beam heating of the exit window is kept below the fatigue limit of the exit window. In some embodiments, compressive stresses from a pressure differential resulting from the cooling medium and the vacuum partially offset tensile stresses on the exit window caused by heating by the electron beam.

In some embodiments, the protruded crown has a thickness of about 0.15 mm to about 0.75 mm. In some embodiments, the protruded crown has a thickness of about 0.35 mm. In some embodiments, the pressure differential created by the cooling medium and the vacuum is at least 690 kPa. In some embodiments, the pressure differential created by the cooling medium and the vacuum is between 100 kPa to 2000 kPa.

In some embodiments, the linear accelerator is capable of pulsing the electron beam at 1-600 hertz.

In some embodiments, the exit window is shaped to fit into a converter target holder. In some embodiments, the exit window is shaped to fit into a production target cooling tube.

In some embodiments, the converter target holder holds Tantalum (Ta) target discs. In some embodiments, the radioisotope comprises molybdenum-99 (99Mo).

In some embodiments, the exit window is mountable to a mating flange utilizing a Conflat™ style knife edge vacuum sealing method. In some embodiments, the exit window is mountable for utilizing welding or brazing techniques.

BRIEF DESCRIPTION OF THE DRAWINGS

Features and advantages of the embodiments of the present invention will become apparent from the following detailed description, taken in combination with the appended drawings, in which.

In the description which follows, like parts are marked throughout the specification and the drawings with the same respective reference numerals.

DETAILED DESCRIPTION OF THE EMBODIMENTS

Figure 1B:
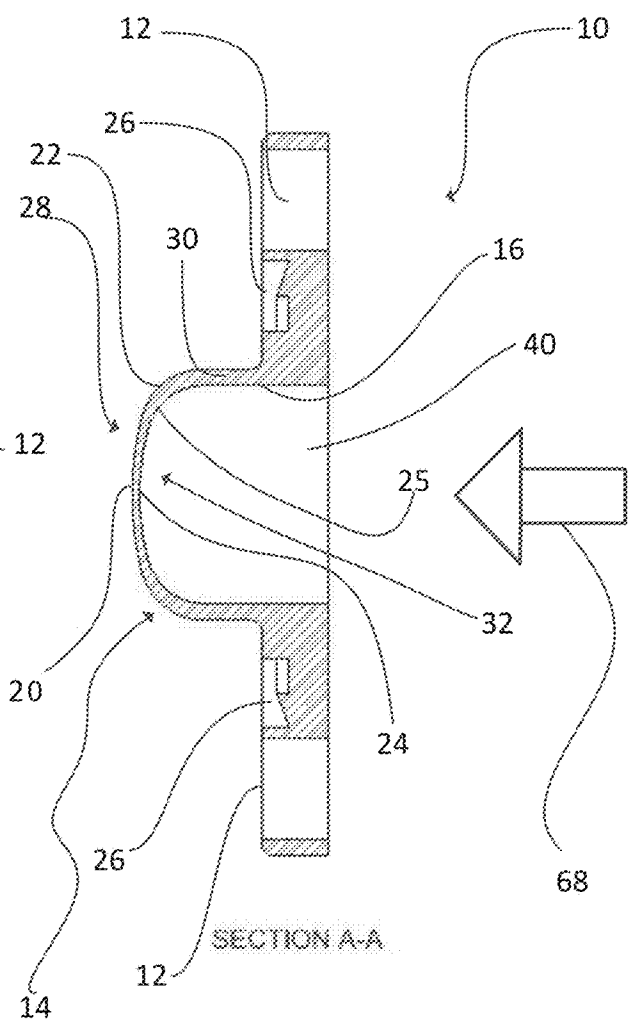
FIG. 1B is a sectional view of section A-A of the exit window of FIG. 1A.

The description which follows and the embodiments described therein are provided by way of illustration of an example or examples of particular embodiments of the principles of the present invention. These examples are provided for the purposes of explanation and not limitation of those principles and of the invention. In some instances, certain structures and techniques have not been described or shown in detail in order not to obscure the invention.

The embodiments described herein relate to an exit window for an electron beam from a linear accelerator for use in producing radioisotopes. The exit window comprises a cylindrical channel operatively connectable at one end to a vacuum chamber configured for travel of the electron beam; and a domed dished head at the other end of the channel. The domed dished head comprises a convex portion having a protruding crown configured for pass-through of the electron beam wherein the geometry of domed dished head is proportioned to resist pressure stress created by cooling medium circulating around the protruding crown and the vacuum in the cylindrical channel and to maintain combined thermal and pressure stresses below the fatigue limit of the material of construction of the exit window.

Isotopes of an element may be produced by ejecting a neutron from the nucleus of the atom by bombarding the atom with relativistic high energy photons, also referred to as gamma radiation. This process is known as the photoneutron or the gamma, neutron ($\gamma$, $\eta$) reaction. The energy of the incident photons exploits the giant resonance neutron peak of the atoms and is typically between 10 and 30 million electron volts (MeV).

The incident photons are produced from the interaction of high energy electrons with a converter target or the production target matter. The high energy electrons originate from an electron linear accelerator. The linear accelerator produces bunched packets of electrons with a speed approaching that of the speed of light at a pulse rate up to the kilohertz (kHz) range. Once the electrons packets strike the target matter, a radiation shower develops. Of the various nuclear interactions that occur in this shower, high energy photon production is one of them.

The electron beam passing through the exit window is produced by a linear accelerator. The linear accelerator is a linear particle accelerator that increases the velocity of charged subatomic particles by subjecting the particles to a series of oscillating electric potentials along a linear beamline. Generation of electron beams with a linear accelerator generally requires the following elements: (i) a source for generating electrons, typically a cathode device, (ii) a high-voltage source for initial injection of the electrons into, (iii) a hollow pipe vacuum chamber whose length will be dependent on the energy desired for the electron beam, (iv) a plurality of electrically isolated cylindrical electrodes placed along the length of the pipe, and (v) a source of radio frequency energy for energizing each of cylindrical electrodes.

The high energy particles generated by the linear accelerator cause photonuclear reactions to occur within the targets. In some embodiments, the photonuclear reaction comprises a photoneutron reaction. In some embodiments, the photonuclear reaction comprises a photofission reaction. In some embodiments, the photonuclear reaction comprises a photodisintegration reaction. In some embodiments, the photonuclear reaction comprises one or more of photoneutron, photofission, and photodisintegration reactions.

Figure 1A:
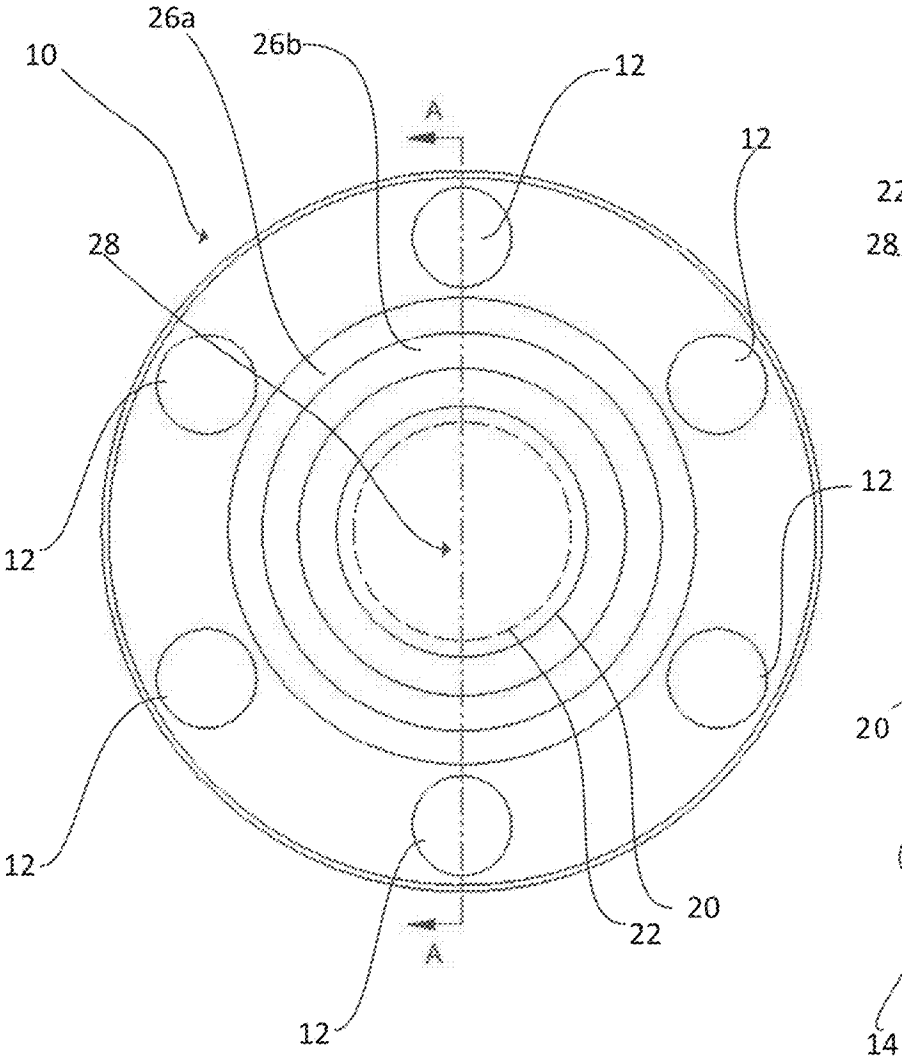
FIG. 1A is a back view of an exit window according to an embodiment of the present disclosure.
Figure 1C:
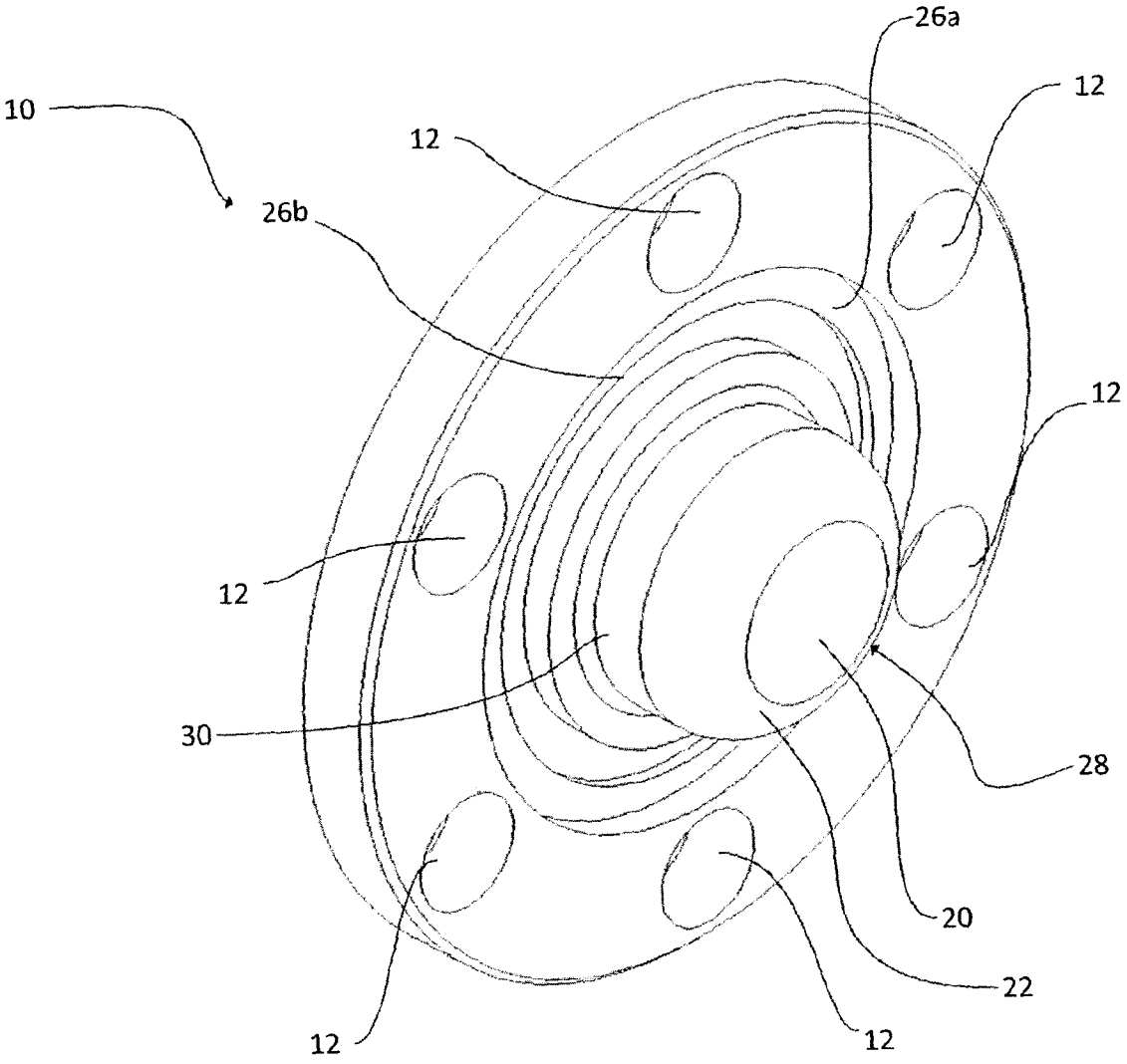
FIG. 1C is a perspective view of the exit window of FIG. 1A.

FIGS. 1A to 1C illustrate an embodiment of the exit window according to the present disclosure. Exit window 10 comprises a channel 40 leading to a domed dished head 14 on one side. The domed dished head 14 comprises convex portions 20 and 22 (corner knuckle) and concave portions 24 and 25 (inner knuckle). When installed onto the converter target holder, the convex portions 20 and 22 of exit window 10 faces the cooling medium that is used to cool the targets, such as $Mo^{100}$ or Tantalum (Ta) targets, and the like, held in the converter target holder. The concave portions 24 and 25 face the vacuum in the channel 40 through which the electron beam 68 travels. In the illustrated embodiment, the convex portions 20 and 22 form a protruding crown 28 through which the electron beam 68 travels and corner knuckle 22 transitions from the protruding crown 28 to the outer channel portion 30. The concave portions 24 and 25 comprise a recessed crown 32 through which the electron beam 68 travels and an inner knuckle 25 that transitions from the recessed crown 32 to the inner channel portion 16.

In this embodiment, exit window 10 has a cross-sectional shape that is externally torispherical (the crown radii and the corner knuckle radii). In some embodiments, exit window 10 has a cross-sectional shape that is externally generally hemispherical or ellipsoidal. In some embodiments, exit window 10 has a cross-sectional shape for fitting onto a converter target holder.

Exit window 10 is removably couplable onto the converter target holder. In the illustrated embodiment, exit window 10 comprises fastener channels 12. Fasteners can be inserted through fastener channels 12 to mount exit window 10 within a converter target holder. In some embodiments, exit window 10 comprises fasteners for fastening it onto a converter target holder. In this embodiment, the fastener channels 12 are cylindrical channels having a circular cross-section. In other embodiments, the fastener channels 12 comprises channels having different cross-sectional shapes. In some embodiments, the exit window 10 could be fastened or welded directly into the production target cooling tube. In some embodiments, exit window 10 can be mounted within a converter target holder using any methods known to a person skilled in the art.

In the illustrated embodiment, the domed dished head 14 has a torispherical profile having defined crown radii and knuckle radii. In some embodiments, the recessed crown 32 has a radii of 12 mm. In some embodiments, the inner knuckle 25 has a radii of 2.7 mm. In some embodiments the protruding crown 28 has a radii of 24 mm and the corner knuckle 22 has a radii of 5.4 mm. In some embodiments, the diameter of the cylindrical channel is at or between 6-10 mm. In some embodiments, the diameter of the cylindrical channel is at or between 10-20 mm.

In some embodiments, the domed dished head 14 has an ellipsoidal profile. In some embodiments, the ellipsoidal profile has an inner minor diameter of 8 mm and an inner major diameter of 10 mm. In some embodiments, the domed dished head 14 has an inner knuckle radii of 30% to 6% of the diameter of the cylindrical channel.

In the illustrated embodiment, the geometry of the domed dished head 14 is proportioned to resist pressure stress created by cooling medium circulating around the convex portions 20 and 22 and the vacuum in the channel 40 and to maintain the combined pressure and thermal stress below the fatigue limit of the material. The exit window 10 is proportioned so that the electron beam 68 passes through the recessed crown 32 and then protruding crown 28. When positioned within the converter target holder 60, the cooling medium flows around the outside of the convex portions 20 and 22 of the exit window 10 and the external major diameter of the exit window 10. The combined mechanical and thermal stress resulting from the pressure differential across the exit window 10 and the heat from the electron beam 68 passing through the exit window 10 are kept below the fatigue limit of the material. Positioning the exit window 10 so that the convex portions 20 and 22 are subject to the higher pressure may reduce the overall stress regime of exit window 10 during operation. The compressive stress from external pressure may also offset the tensile stress caused by electron beam 68 heating of the exit window 10.

The exit window 10 also has to separate the linear accelerator vacuum from a pressurized cooling medium or liquid target medium (i.e., greater than atmospheric pressure) and withstand the pressure differential created by the cooling medium and the vacuum. In some embodiments, exit window 10 can withstand a pressure differential that is less than 690 kPa. In some embodiments, exit window 10 can withstand a pressure differential equal to or greater than 690 kPa. In some embodiments, exit window 10 can withstand a pressure differential that is at or between the range of 100 kPa to 2000 kPa.

In the embodiment illustrated in FIGS. 1A-1C, exit window 10 comprises portions for effecting a vacuum seal across the back flange of the exit window 10. In this embodiment, exit window 10 comprises circular cut-outs **26*a* and 26*b* which are shaped to fit a gasket, which may be made of copper or other materials known to a person skilled in the art. In this embodiment, the vacuum seal is formed using a Conflat™ knife edge flange. The knife edge cuts into the copper gasket to effect the vacuum seal. In some embodiments, exit window 10** is mountable for utilizing welding or brazing techniques.

In the illustrated embodiment, protruding crown 28 has a circular cross-sectional shape. In some embodiments, protruding crown 28 has a generally oval cross-sectional shape. In some embodiments, protruding crown 28 has an elliptical cross-sectional shape.

In some embodiments, the convex portions 20 and 22 of exit window 10 are polished to reduce the likelihood of surface cracks developing in the exit window 10 due to high cycle fatigue. In some embodiments, the concave portions 24 and 25 of exit window 10 are polished to reduce the likelihood of surface cracks developing in the exit window 10 due to high cycle fatigue. The polishing may be done using steel wool and polishing compound and then polishing compound as applied to a buffing cloth.

The exit window 10 is formed of a material that is of lower cost, has high machinability, is resistant to aggressive media, has high tensile strength at elevated temperatures, and has a predictable fatigue limit, or a combination of any or all of the foregoing. In one embodiment, the exit window is formed of Ti-6Al-4V. In some embodiments, the exit window 10 is formed of beryllium, copper, steel, stainless steel, titanium, alloys of any of the foregoing, or a combination of any of the foregoing. Other metal, metal alloys, or materials known to a person skilled in the art could be used provided the metal, metal alloy, or material is compatible with the cooling medium and the stress levels on the exit window 10 remain below the fatigue limit of the material at temperature.

In the illustrated embodiment, the exit window 10 is located between an evacuated linear accelerator or a linear accelerator antechamber and a pressurized fluid cooled target. In the embodiments with a liquid target, the exit window 10 is configured to contain the liquid itself.

In some embodiments, the exit window 10 can withstand cooling medium or liquid target medium that is aggressive. In some embodiments, the cooling medium or liquid target medium is oxidizing. In some embodiments, the cooling medium or liquid target medium is acidic. In some embodiments, the cooling medium or liquid target medium is de-ionized.

In the illustrated embodiment, the electron beam 68 from the linear accelerator is stationary and not swept. In some embodiments, the electron beam 68 has an energy of at least 30 MeV, which is much higher than most commercial processing installations (e.g., less than 10 MeV). In some embodiments, the linear accelerator is capable of producing an electron beam having at least 5 kW of power to about 150 kW of power and to produce a flux of at least 10 MeV to about 50 MeV bremsstrahlung photons. In some embodiments, the linear accelerator is capable of producing an electron beam having about 150 kW of power. In some embodiments, the electron beam is a pulsed beam. In some embodiments, the linear accelerator is capable of pulsing the electron beam at 1 to 600 hertz.

In the illustrated embodiment, exit window 10 can withstand the cyclic temperature fluctuations caused by the pulsed electron beam 68.

The exit window 10 in the illustrated embodiment has a geometry which allows the structure of exit window 10 to flex outward from internal heating of the exit window 10 induced by the electron beam 68 and to flex inward from external pressure, such as the pressure from the pressurized cooling medium or liquid target medium. The geometry of exit window 10 as described in the illustrated embodiments allows the exit window 10 to withstand the pressure differential between 100 kPa to 2000 kPa.

In some embodiments, the thickness of the portion of the protruding crown 28 through which the electron beam 68 passes is at least 0.35 mm. In some embodiments, the thickness of the portion of the protruding crown 28 has a varying thickness in the range of 0.15 mm to 0.75 mm. In some embodiments, the thickness of the outer channel portion 30 is 0.75 mm. Varying the thickness of the protruding crown 28 allows exit window 10 to flex under stress while maintaining the stress under the fatigue limit of the material of exit window 10. Different portions of exit window 10 may have different thicknesses depending on the pressure of the pressurized cooling medium or target medium and the temperature fluctuations due to heating induced by electron beam 68.

Figure 2:
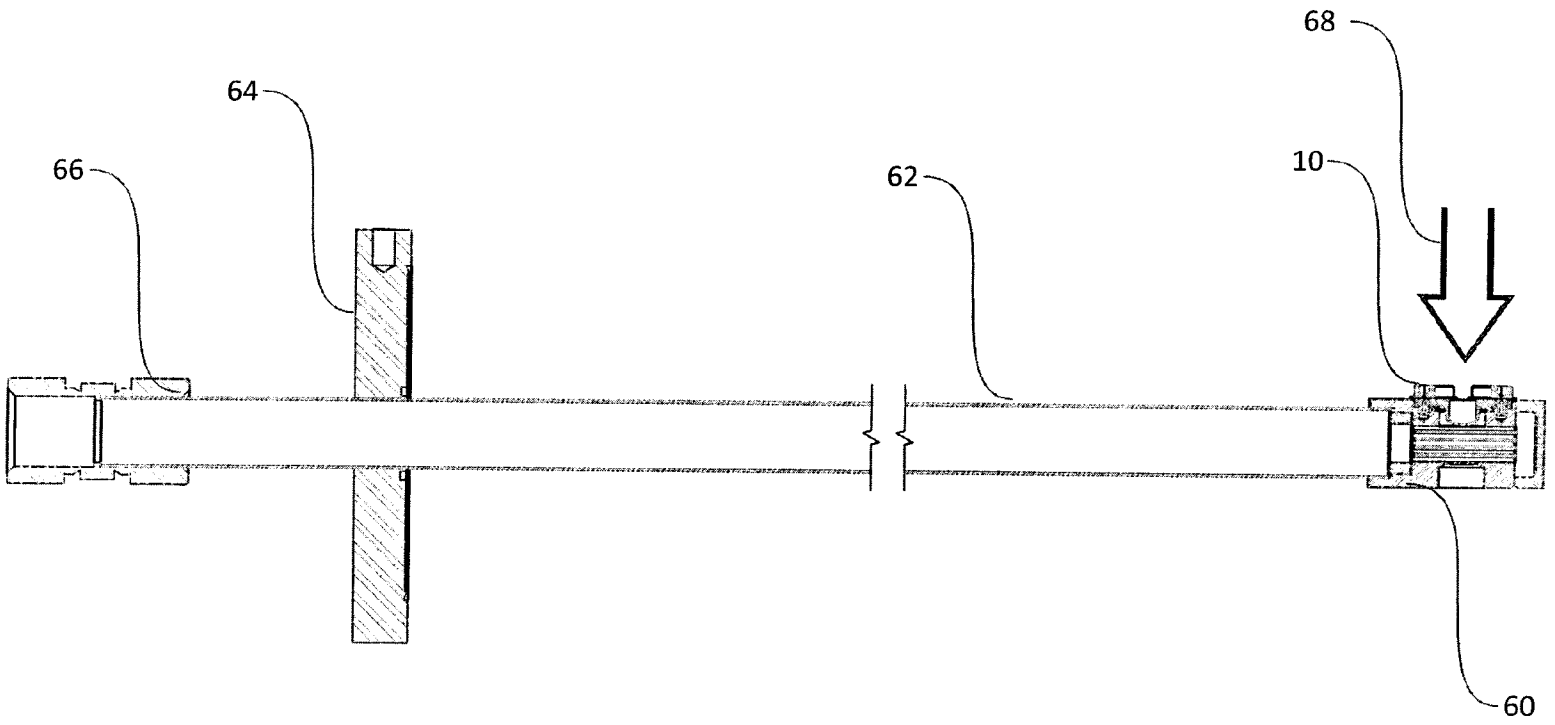
FIG. 2 is a side view of a converter target holder and associated cooling components according to an embodiment of the present disclosure.

FIG. 2 illustrates the exit window 10 fitted into the converter target holder 60. In one embodiment, the exit window 10 is mounted to a flange that utilizes a Conflat™ style knife edge vacuum sealing method. In some embodiments, there is a copper gasket in between the two knife edges. In some embodiments, other vacuum sealing methods known to a person skilled in the art may also be used. In some embodiments, the window flange is replaceable. In some embodiments, exit window 10 is fully welded onto converter target holder 60. In some embodiments, graphite ring seal may be used for connecting the exit window 10 to converter target holder 60.

The converter target holder 60 is operatively connected to piping 62 that allows cooling medium to travel into the converter target holder 60. In this embodiment, the exit window 10 is fitted into the converter target holder 60 and electron beam 68 is directed through the exit window 10 and into converter target holder 60. Conflat™ flange 64 seals the converter target assembly into the vacuum chamber and fitting 66 connects the water supply to the converter target assembly. In the illustrated embodiment, the commercial radioisotope comprises molybdenum-99 ($^{99}$Mo) and the targets comprise molybdenum-100 ($^{100}$Mo) or Ta target discs. In some embodiments using the photo-neutron reaction, the commercial radioisotope comprises 47Sc, 67Cu, or 88Y and the corresponding targets comprise 48Ti, 68Zn, or 89Y. In some embodiments using the neutron capture reaction, the commercial radioisotope comprises 32P, 46Sc, 56Mn, 75Se, 90Y, 166Ho, 177Lu, 192Ir, 198Au and the corresponding targets comprises 31P, 45Sc, 55Mn, 74Se, 89Y, 165Ho, 176Lu, 191Ir, 197Au. In some embodiments, using the photo-fission reaction, the commercial radioisotope comprises $^{99}$Mo from photon induced fission of $^{238}$U or neutron induced fission of $^{235}$U from ejected neutrons.

In some embodiments, converter target holder 60 comprises the bremsstrahlung converter station 70 as described in PCT Patent Application Nos. PCT/CA2014/050479 and PCT/CA2015/050473.

Testing of an embodiment of the exit window 10 was conducted over multiple linear accelerator runs with varying power levels and run durations. All tests were conducted by confirming proper vacuum conditions in the vacuum chamber and establishing cooling water flow over the back of the exit window 10. The linear accelerator is turned on and beam power is increased from 1 kW to the target power level in 2 kW to 5 kW increments averaging two minutes between each increment. Initial testing was conducted at power levels ranging from 1 kW to 24 kW and durations of beam pulsing from under an hour to approximately ten hours. Further testing was done with 72 hour endurance runs conducted at 24 kW beam power and at 30 kW beam power. With these tests, an embodiment of the exit window 10 was subject to 370 million electron beam pulses, at beam power ranging from 1 kW to 30 kW, and exit window 10 did not suffer any cracks or damage to its structural integrity as a result of such electron beam pulsing and the high cycle stresses created by such pulsing. This embodiment of exit window 10 was subject to a further 90 million electron beam pulses, totalling 460 million electron beam pulses, at beam power ranging from 1 kW to 30 kW, and such embodiment did not suffer any cracks or damage to its structural integrity as a result of such electron beam pulsing and the high cycle stresses created by such pulsing.

The methods and systems disclosed herein may provide some advantages:

- By employing a domed dished head profile, the exit window 10 can have a lower thickness which can lower thermal stress on the exit window 10 caused by the electron beam.
- While the illustrated embodiment has a cylindrical channel, the channel may have other shapes that allow pass-through of the electron beam.
- The geometry of the exit window 10 can provide flexibility to allow the exit window 10 to maintain lower stress levels as the exit window 10 contracts and expands as a result of the pressure differential and the temperature fluctuation caused by the pulsed electron beam, respectively.
- Exit window 10 lasts longer when compared to a chemical vapor deposition diamond exit window, resulting in increased production and reduced downtime. For example, a 600 Hz pulsed electron beam would cause a typical exit window (without the features of exit window 10) to fail in around 10,000,000 cycles, or 4.6 hours. For isotope production, this translates to less radioactive waste and less radiation dose to workers who have to replace or handle the activated components.

Where a component is referred to above, unless otherwise indicated, reference to that component should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions, and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

The embodiments of the invention described above are intended to be exemplary only. Those skilled in this art will understand that various modifications of detail may be made to these embodiments, all of which come within the scope of the invention.

What is claimed is:

1. An exit window for an electron beam from a linear electron accelerator for use in producing radioisotopes comprising:

a cylindrical channel operatively connectable at one end to a vacuum Chamber configured for travel of the electron beam, Which has a Gaussian profile and peak flux approximately centered on a centerline of the electron beam; and a domed dished head at the other end of the channel, the domed dished head comprising a convex portion comprising two or more distinct convex radii and a concave portion comprising two or more distinct concave radii that differ from the two or more convex radii, wherein the two or more convex radii and the two or more concave radii provide for a gradual thickening of the window from a centerline of the exit window to the channel, allowing the domed dished head to resist pressure stress created by cooling medium circulating around a protruding crown of the domed dished head and the vacuum in the cylindrical channel and to maintain a combination of thermal stress and the pressure stress below the fatigue limit of the material forming the exit window.

2. The exit window of claim 1 wherein the protruding crown has a circular or oval shape.

3. The exit window of claim 1 wherein the exit window is a single integral piece.

4. The exit window claim 1 wherein the exit window comprises beryllium, copper, steel, stainless steel, titanium, alloys of any of the foregoing, or a combination of any of the foregoing.

5. The exit window of claim 1 wherein the exit window comprises Ti-6Al-4AV.

6. The exit window of claim 1 wherein the window is removably mountable to a window flange.

7. The exit window of claim 1 wherein the exit window has a thickness ranging from 0.15 mm to 0.75 mm.

8. The exit window of claim 1 wherein the exit window is shaped to fit into a converter target holder.

9. The exit window of claim 1 wherein the exit window is shaped to fit into a production target cooling tube.

10. The exit window of claim 1 wherein the exit window comprises two or more fastener channels to allow the exit window to be mountable to a mating flange of a converter target holder utilizing a knife edge vacuum sealing method.

11. The exit window of claim 1 wherein the exit window comprises two or more fastener channels to allow the exit window to be mountable to a converter target holder utilizing welding or brazing techniques.

* * * * *